US005452040A

United States Patent [19]

Nishida et al.

[11] Patent Number: 5,452,040

[45] Date of Patent: Sep. 19, 1995

[54] FILM DEVELOPING APPARATUS

[75] Inventors: Shigeki Nishida; Toru Tanibata, both of Wakayama, Japan

[73] Assignee: Noritsu Koki Co., Ltd., Wakayama, Japan

[21] Appl. No.: 190,838

[22] Filed: Feb. 3, 1994

[30] Foreign Application Priority Data

Feb. 5, 1993 [JP] Japan ..... 5-042097

[51] Int. Cl.[6] ..... G03D 13/00; G03D 3/08

[52] U.S. Cl. ..... 354/298; 354/321; 354/334

[58] Field of Search ..... 354/298, 299, 324, 334; 355/27, 28, 29

[56] References Cited

U.S. PATENT DOCUMENTS

| | | | |
|---|---|---|---|
| 3,995,959 | 12/1976 | Shaber | 354/298 X |
| 4,335,956 | 6/1982 | Findeis | 355/27 |
| 4,881,095 | 11/1989 | Shidara | 354/298 |
| 5,063,583 | 11/1991 | Galkin | 378/207 |
| 5,319,408 | 6/1994 | Shiota | 354/298 |

FOREIGN PATENT DOCUMENTS

| | | |
|---|---|---|
| 0149850 | 7/1985 | European Pat. Off. . |
| WO82/01940 | 6/1982 | WIPO . |

*Primary Examiner*—D. Rutledge

*Attorney, Agent, or Firm*—Oblon, Spivak, McClelland, Maier & Neustadt

[57] ABSTRACT

A film developing apparatus includes an exposure section for effecting a standard exposure on a photosensitive film under a predetermined condition in a manner similar to that for exposing a control strip. The apparatus further includes a transfer path for transferring the exposed film for development, a densitometer for measuring the density of the developed film, and a device for displaying the condition of the processing solution which is determined based on the measured density. The standard exposure is effected on an unexposed film which is specially provided for the standard exposure, or on a part of an ordinary film with which pictures has been taken. The plural conditions may be set for the density measurement and for the standard exposure. The film developing apparatus is provided with a sensor for detecting the kind of a film to be exposed, and for selecting conditions based on the kind of the film.

4 Claims, 6 Drawing Sheets

FILM DEVELOPING APPARATUS

BACKGROUND OF THE INVENTION

1. Field of the Invention

The present invention relates to an apparatus for developing a photographic film, and more particularly to an improved film developing apparatus with which the condition of a developing solution is monitored for controlling the developing solution.

2. Discussion of Related Art

Conventional film developing apparatuses for developing photographic films include a developing section, a drying section, etc. Currently, so-called automatic developing apparatuses which include a CPU for controlling various. factors which affect the developing process are widely used. In the use of such automatic developing apparatuses, a developing solution must be controlled with the greatest care.

Controlling of a processing solution in the film developing section is generally carried out by the use of a so-called control strip. The control strip is an undeveloped film which has predetermined reproductive characteristics and has been exposed to light under standard exposure conditions in which the intensity of light, exposure time and the characteristics of light are previously determined. After the control strip is developed, the density of the film is measured to determine the exhaustion degree of the developing solution.

Since the control strip must be processed in dark, it is put in a dark box, called "control strip holder" in a darkroom. The control strip is then set in a receiving inlet of the developing section of a film developing apparatus together with a holder therefor.

As described above, in conventional film developing apparatuses, controlling of developing solution is carried out based on the results obtained by developing the control strip housed in the control strip holder. However, the control strip holder involves drawbacks in that the mechanism for receiving the control strip is not simple due to the necessity of light-shielding, causing a troublesome operation for loading the control strip into the control strip holder.

Moreover, at the time of setting a control strip holder in a film developing apparatus, complicated operation is required because of the requirement of complete shielding of light. For checking the condition of the developing solution, it is required to stop the general development processes, and then to set a control strip holder containing a control strip in the film processing apparatus.

In many cases, however, developing solutions are controlled without the use of a control strip, because the loading of the control strip into the control strip holder and the setting of the control strip holder into the film developing apparatus are cumbersome, and the control strip must be specially prepared as a material for controlling the developing solution. In such cases, controlling of the developing solutions is carried out by a well-trained operator who intuitively determines the condition of the developing solution based on the frequency of processing, operation cycle time of the film developing apparatus, and the quality of the processed negative films.

In such, there arise fears that a misjudgment of the operator may happen in controlling the developing solution, which will allow deteriorated developing.

Further, hiring of well-trained operators is against the automation and simplification of processing.

SUMMARY OF THE INVENTION

An object of the present invention is to provide an improved film developing apparatus in which the developing solution can be controlled easily.

Another object of the present invention is to provide an improved film developing apparatus with which the developing process is simplified, and the quality of developed materials is improved.

Briefly, a film developing apparatus according to the present invention is characterized by including an exposure section for effecting a standard exposure under predetermined conditions, means for measuring the density of the film after development, and means for indicating the condition of the developing solution based on the data of measured density.

Here, explanation is given to the "standard exposure". Conventionally, an undeveloped film which has been exposed under predetermined conditions (intensity of light, exposure time and characteristics of light) is used as a control strip. The control strip is passed through a developing solution for determining the condition of the developing solution based on the color developed. The exposure effected under such predetermined conditions to provide a control strip is called "standard exposure". In the present invention, a standard exposure is effected in the exposure section provided in the film developing apparatus.

According to the present invention, since the standard exposure can be effected in the exposure section of the film developing apparatus to prepare a "substitute" control strip for conventional control strips, troublesome works involved in loading of a control strip into a control strip holder and setting of the control strip holder to the film developing apparatus can be eliminated, by which easy checking and indicating of the condition of the developing solution is achieved. Moreover, since the developing solution is automatically controlled, a stable quality of developing can be secured. Furthermore, since it is not necessary to keep special materials for controlling developing solutions, processing of films can be simplified.

BRIEF DESCRIPTION OF THE ACCOMPANYING DRAWINGS

Various other objects, features and many of the attendant advantages of the present invention will be readily appreciated as the same becomes better understood by reference to the following detailed description of the preferred embodiments when considered in connection with the accompanying drawings, in which.

DETAILED DESCRIPTION OF PREFERRED EMBODIMENTS

Figure 1:
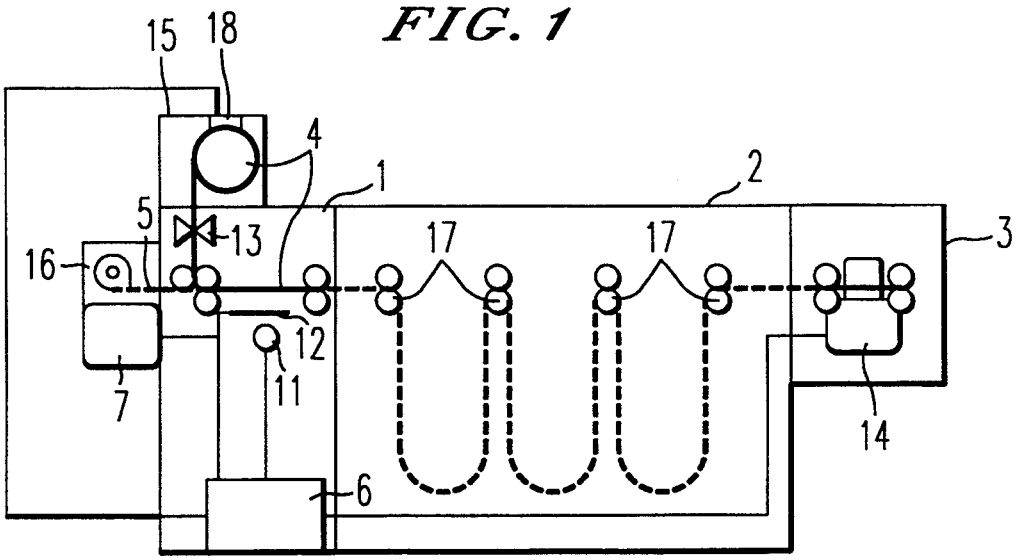
FIG. 1 is a schematic sectional view showing a film developing apparatus according to a first embodiment of the present invention.

The present invention will now be described with reference to the accompanying drawings. FIG. 1 is a schematic sectional view showing a film developing apparatus according to a first embodiment of the present invention. The film developing apparatus is mainly composed of an exposure section 1, a developing section 2, a density measurement section 3, a control section 6 and a monitor 7. The film developing apparatus is provided with an ordinary film inlet 16 through which an ordinary film is inserted. A plurality of guide rollers 17 are disposed in the film developing apparatus for transferring the inserted ordinary film 5 to the developing section 2 and then to the density measurement section 3.

A magazine 15 is mounted on the exposure section 1 for holding a film cartridge loaded with an unexposed film 4. The unexposed film 4 is transferred to the developing section 2 via the exposure section 1. Numeral 18 denotes a sensor for reading a DX code on the film cartridge which indicates the kind of the unexposed film 4. A lamp 11 and a shutter 12 are disposed in the exposure section 1 for exposing the unexposed film 4. A cutter 13 is also disposed in the exposure section 1 for cutting the unexposed film 4 into a predetermined length. Further, a densitometer 14 is disposed in the density measurement section 3.

In the exposure section 1, the unexposed film 4 pulled out from the magazine 15 is exposed to a light beam from the lamp 11 under predetermined standard exposure conditions when shutter 12 is opened. The lamp 11 and the shutter 12 are controlled by the control section 6 for effecting a standard exposure on the unexposed film 4. The exposure forms a test pattern including a transparent area, a gray area and a black area on the film 4. The film 4 is then transferred, by the rollers 17 without using a leader for transferring, to the developing section 2, in which the film 4 is developed. The film 4 is then transferred to the density measurement section 3 in which the density of the film 4 is measured by the densitometer 14 so as to obtain the density of each of the three primary colors in the transparent area, gray area and black area of the test pattern formed on the film 4.

The DX code printed on the cartridge is read by the sensor 18, and then fed to the control section 6. The control section 6 calculates with regard to the condition of the processing solution for each kind of the film 4. The measured values of density are displayed on the monitor 7 together with data indicating whether or not the condition of the processing solution is in a predetermined usable range.

The ordinary film 5 which has been used as housed in a camera for taking pictures is inserted into the ordinary film inlet 16. In this case, the shutter 12 is not opened, and the film 5 is transferred to the developing section 2 via the exposure section 1. In the developing section, an ordinary developing is taken place.

Figure 2:
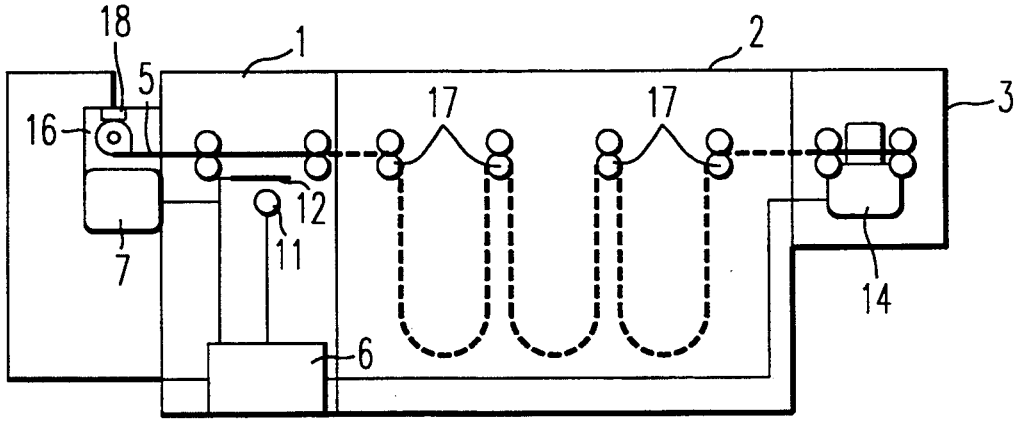
FIG. 2 is a schematic sectional view showing a film developing apparatus according to a second embodiment of the present invention.

FIG. 2 is a sectional cross section showing a second embodiment of the film developing apparatus according to the present invention. In the drawing, sections and components which are the same as those in the first embodiment are denoted by the same reference numbers.

In the second embodiment, a film for undergoing standard exposure as used in the first embodiment is not utilized.

An ordinary film which has been used as housed in a camera for taking pictures is fed to the exposure section 1, in which the leading end or tailing end of the ordinary film 5 is exposed to a light beam from the lamp 11 under the standard exposure conditions when the shutter 12 is opened. Similar to the first embodiment, the lamp 11 and the shutter 12 are controlled by the control section 6 for obtaining the standard conditions.

The film 5 is then transferred by the rollers 17 without using a leader for transferring to the developing section 2, in which the film 5 is developed. The film 5 is then transferred to the density measurement section 3 in which the density of the film 4 is measured by the densitometer 14. The DX code printed on the cartridge of the film 5 is read by the sensor 18, and is then fed to the control section 6. The control section 6 calculates with regard to the condition of the processing solution for each kind of the film 5. The measured values are displayed on the monitor 7 together with data indicating whether or not the condition of the processing solution is in a predetermined usable range.

Figure 3:
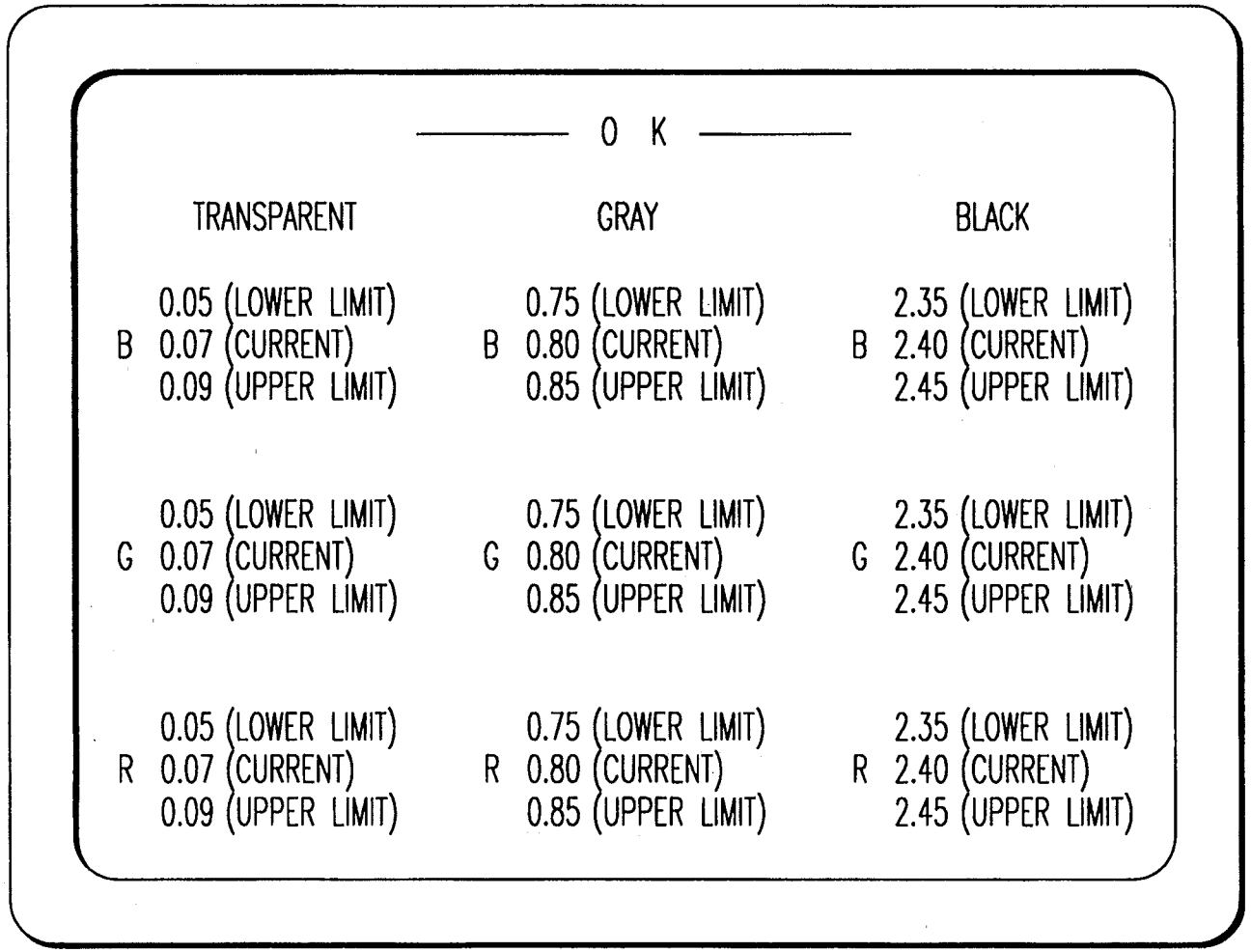
FIG. 3 is an explanatory illustration showing a display of a monitor used in the film developing apparatuses according to the embodiments.

FIG. 3 is an explanatory illustration of a display for monitoring the condition of the developing solution used in the film developing apparatuses shown in FIGS. 1 and 2. As FIG. 3 shows, the display presents information concerning the upper limits and lower limits of densities for the primary three colors, measured density values for each color and information indicating whether or not the processing solution currently used is still usable.

Figure 4:
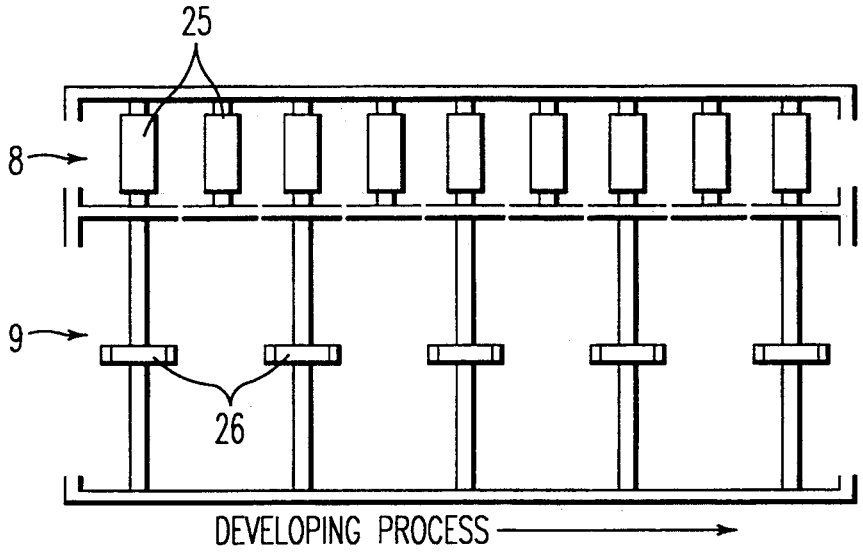
FIG. 4 is a schematic sectional view showing an example of the film transferring mechanism used in the film developing apparatuses according to the embodiments.
Figure 5:
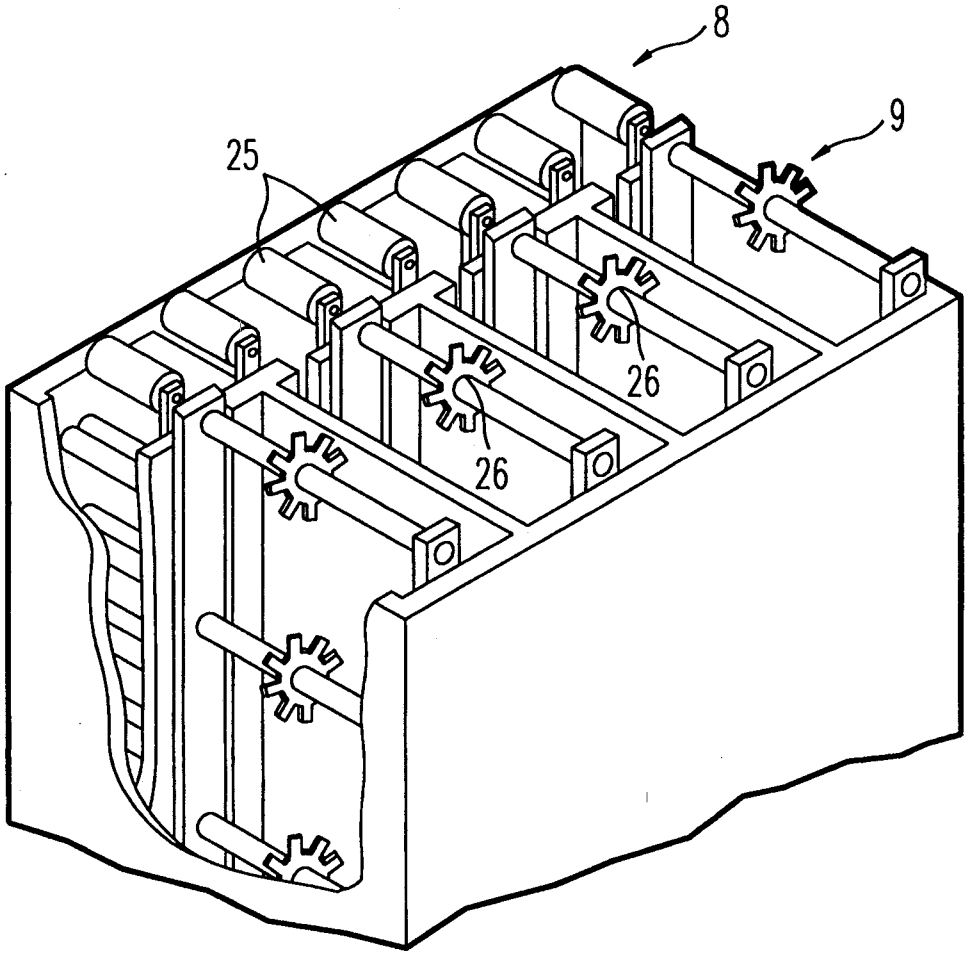
FIG. 5 is a schematic perspective view of the film transferring mechanism shown in FIG. 4.

In the first embodiment shown in FIG. 1, the film 4 is transferred along a transfer path as shown in FIGS. 4 and 5. In the drawings, numeral 8 denote a transfer path for the film 4, numeral 9 denotes a path for the ordinary film 5, numeral 25 denotes rollers and numeral 26 denotes sprockets. As described above, the film 4 which is a "substitute" control strip is transferred by roller 25 along the path 8 disposed parallel to the path 9 for ordinary film 5. This arrangement allows the film 4 to be exposed and developed even when the ordinary film 5 is developed.

Figure 6:
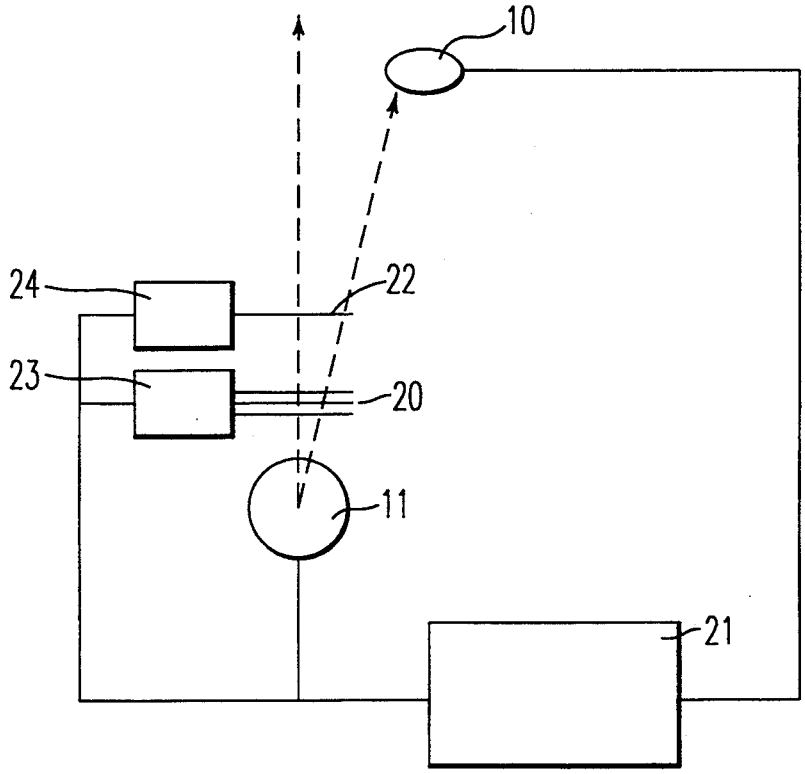
FIG. 6 is an explanatory chart showing an example of the light source used in the exposure sections of the film developing apparatuses according to the embodiments.

FIG. 6 is an explanatory chart showing an example of the light source used in the exposure sections of the film developing apparatuses according to the embodiments. In the drawing, numeral 10 denotes a sensor, numeral 11 denotes the lamp, numeral 20 denotes a light controlling filter, numeral 21 denotes a control section, numeral 22 denotes a mechanical shutter, numeral 23 denotes a filter drive section, numeral 24 denotes a shutter actuation section. The quantity of light and the color temperature are detected by the sensor 10, upon which the control section 21 automatically controls the voltage applied to the lamp 11, and the light controlling filters 20 in accordance with the kind of the film detected by the sensor 18. The light controlling filters 20 are YMC color filters, and they are advanced or retracted to control the color of the exposure light.

Figure 7:
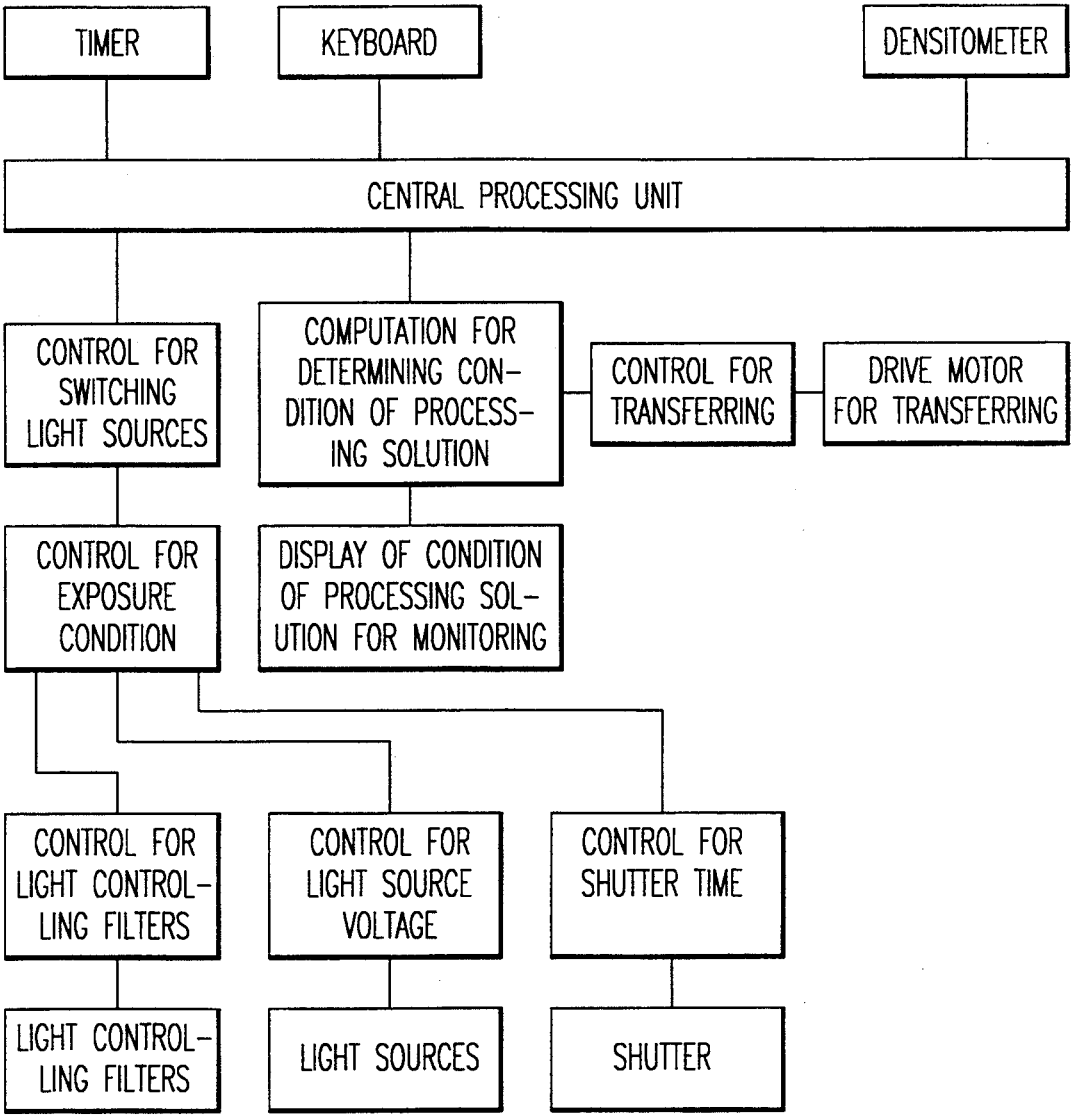
FIG. 7 is a block diagram showing an example of the control section used in the film developing apparatuses according to the embodiments.

FIG. 7 is a block diagram showing an example of the control section 6 used in the film developing apparatuses according to the embodiments. The control section 6 includes functional blocks for controlling the exposure conditions for effecting a standard exposure in response to signals which are output from a timer at predetermined intervals or to input signals which are output from a keyboard at arbitrary timings. The control section 6 also includes functional blocks for controlling the transferring of the films, and functional blocks for calculating the condition of the processing solution based on data output from the densitometer 14 and for displaying the condition.

Figure 8:
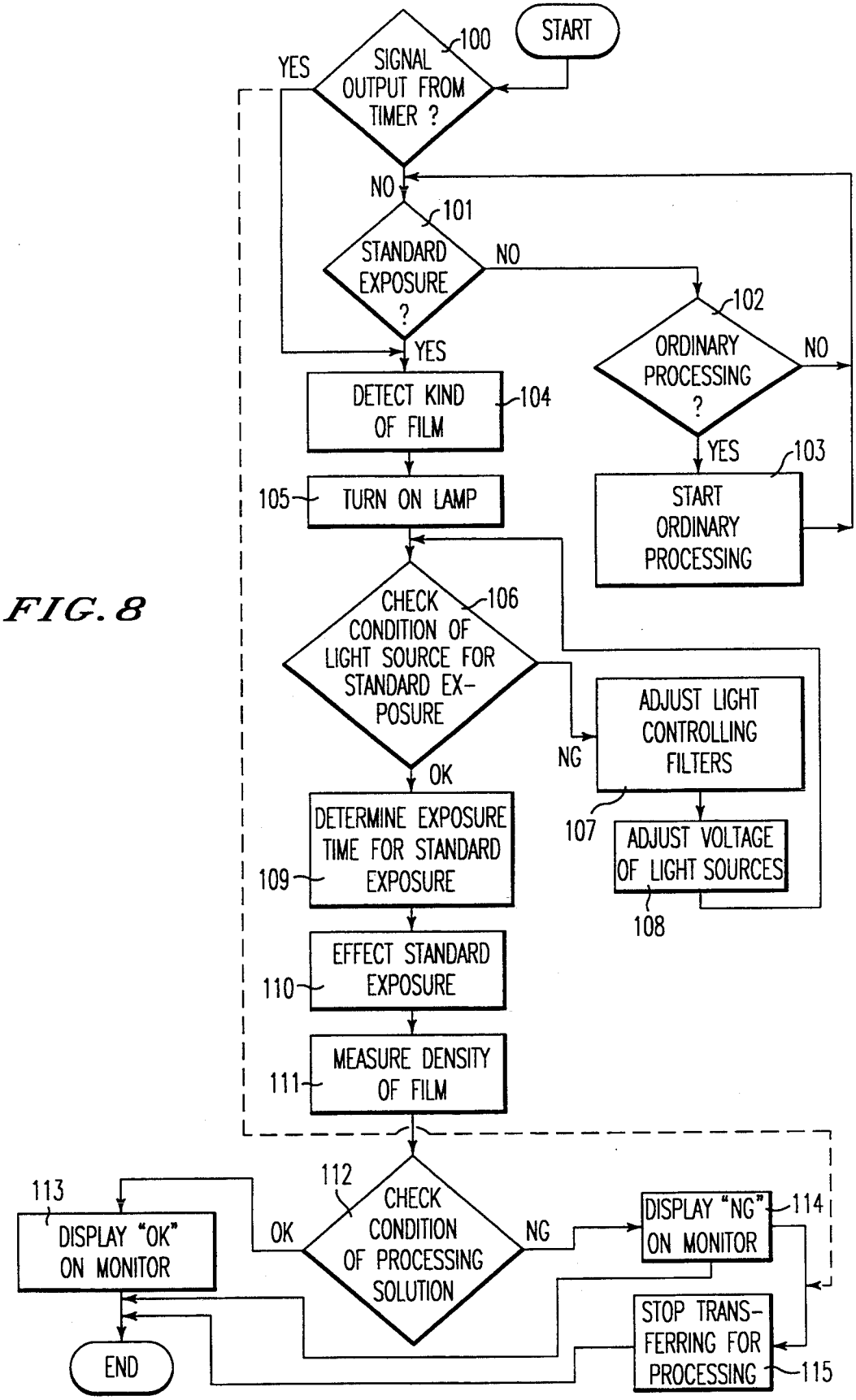
FIG. 8 is a flowchart showing operation of a control section used in the film developing apparatuses according to the embodiments.

FIG. 8 is a flowchart showing the operation of the film developing apparatuses according to the embodiments.

In cases where a signal is not output from the timer or the keyboard, the processes in steps 101, 102 and 103 are repeated for carrying out ordinary developing.

Whenever it is detected in step 100 that a signal is output from the timer at predetermined timings, the process moves from step 100 to step 104 for automatically carrying out a standard exposure. After the detection of the kind of a film in step 104, the exposure conditions for the standard exposure, such as, the intensity of light and exposure time are adjusted and confirmed in steps 105 through 109. It is to be noted that plural sets of exposure conditions corresponding to kinds of films are memorized in a memory (not illustrated) of a CPU, and suitable exposure conditions are selected at step 104. Subsequently, a standard exposure is effected on the film (namely, unexposed film 4 or ordinary film 5) in step 110.

After the film is developed, the density of the film is measured in step 111, and the condition of the processing solution is calculated based on the density. It is to be noted that plural sets of measurement conditions corresponding to kinds of films are memorized in the memory (not illustrated) of the CPU, and suitable measurement conditions are used in step 111. Information indicating the condition of the solution is then displayed on the monitor 7 as shown in FIG. 3. After that, it is determined in step 112 whether or not the condition of the processing solution is within a predetermined usable range. When it is judged that the condition is within the predetermined usable range, "OK" is displayed on the monitor 7 in step 113. On the contrary, when it is judged that the condition is outside the predetermined usable range, "NG" is displayed on the monitor 7 in step 114. In this case, the transferring of the film for processing is stopped in step 115 for preventing ordinary films from being developed in deteriorated conditions, thereby maintaining the quality of the developing.

In the above-described embodiments, a standard exposure and determination of the condition of the processing solution are carried out at predetermined intervals. However, they may be carried out after every predetermined number of processing of ordinary films. Further, the film developing apparatus may be Controlled such that it is stopped if the standard exposure and the determination of the condition of the processing solution has not been carried out for a predetermined period of time. As indicated by the broken line in FIG. 8, the operation of the control section 6 may be modified in such a way that the developing procedure is automatically stopped after elapse of predetermined period of time, without checking the condition of the processing solution.

Obviously, numerous modifications and variations of the present invention are possible in light of the above teachings. It is therefore to be understood that within the scope of the appended claims, the present invention may be practiced otherwise than as specifically described herein.

What is claimed is:

1. A film developing apparatus comprising:

standard exposure means for exposing, under predetermined exposure conditions, a standard photographic film which is specially provided for judging the condition of a processing solution;

first developing means for developing said standard photographic film along a first transfer path using a processing solution;

second developing means for developing an ordinary photographic film in a second transfer path different from said first transfer path using the same processing solution used by said first developing means;

density measurement means for measuring a density of the film which has been exposed by said standard exposure means and has been developed by said first developing means; and judging and displaying means for judging the condition of the processing solution based on the density measured by said density measurement means and for displaying the results of the judgement.

2. A film developing apparatus according to claim 1, further comprising a transfer mechanism having a plurality of transfer rollers for transferring the film used for judging the condition of the processing solution without using a leader.

3. A film developing apparatus according to claim 2, wherein said standard exposure means selects exposure conditions from plural sets of exposure conditions corresponding to kinds of standard photographic films capable of being used for effecting said standard exposure.

4. A film developing apparatus according to claim 2, wherein said density measurement means selects measurement conditions from plural sets of measurement conditions corresponding to kinds of standard photographic films capable of being used for carrying out the measurement.

* * * * *